US005572211A

United States Patent [19]

Erhart et al.

[11] Patent Number: 5,572,211

[45] Date of Patent: Nov. 5, 1996

[54] INTEGRATED CIRCUIT FOR DRIVING LIQUID CRYSTAL DISPLAY USING MULTI-LEVEL D/A CONVERTER

[75] Inventors: Richard A. Erhart, Chandler; Thomas W. Ciccone, Paradise Valley, both of Ariz.

[73] Assignee: Vivid Semiconductor, Inc., Chandler, Ariz.

[21] Appl. No.: 183,474

[22] Filed: Jan. 18, 1994

[51] Int. Cl.[6] ..... G09G 1/16; G09G 3/00

[52] U.S. Cl. ..... 341/144; 341/145

[58] Field of Search ..... 341/53, 145, 141, 341/144, 151, 147; 345/27

[56] References Cited

U.S. PATENT DOCUMENTS

| | | | |
|---|---|---|---|
| 4,233,591 | 11/1980 | Murata | 340/347 |
| 4,446,490 | 5/1984 | Hoshimi | 360/32 |
| 4,575,721 | 3/1986 | Delgrange et al. | 340/776 |
| 4,636,784 | 1/1987 | Delgrange et al. | 340/771 |
| 4,714,921 | 12/1987 | Kanno et al. | 340/784 |
| 4,845,488 | 7/1989 | Kelly | 340/721 |
| 4,955,696 | 9/1990 | Taniguchi et al. | 350/332 |
| 5,120,991 | 6/1992 | Takahashi | 307/270 |
| 5,168,270 | 12/1992 | Masumori et al. | 340/784 |
| 5,170,155 | 12/1992 | Plus et al. | 340/784 |
| 5,170,158 | 12/1992 | Shinya | 340/800 |
| 5,191,333 | 3/1993 | Nakano | 341/145 |
| 5,192,945 | 3/1993 | Kusada | 340/784 |
| 5,198,747 | 3/1993 | Haight | 323/303 |
| 5,198,818 | 3/1993 | Samueli | 341/144 |

*Primary Examiner*—Jeffrey A. Gaffin
*Assistant Examiner*—Peguy Jean Pierre
*Attorney, Agent, or Firm*—Cahill, Sutton & Thomas, P.L.C.

[57] ABSTRACT

An integrated circuit is provided for generating analog output voltages for a series of column driver output circuits used to drive an active or passive matrix LCD display. The digital value corresponding to the shade of gray for each column is stored on the integrated circuit. A shift register is clocked to sequentially enable tap points of a resistive divider network for providing four monotonically increasing analog voltages on each shift register clock cycle. A binary counter is clocked along with the shift register, and the more significant bits of the stored digital value for each column driver output circuit are each compared with the current binary count to detect a correlation. Upon detecting a correlation, the two least significant bits of the stored digital value for each column driver circuit are used to select one of the four analog voltages during the current counter cycle, and the selected analog value is sampled and held for driving a column of the LCD display.

36 Claims, 5 Drawing Sheets

INTEGRATED CIRCUIT FOR DRIVING LIQUID CRYSTAL DISPLAY USING MULTI-LEVEL D/A CONVERTER

BACKGROUND OF THE INVENTION

1. Field of the Invention

The present invention relates generally to integrated circuits for driving an active or passive matrix liquid crystal display (LCD) or the like, and more particularly, to an integrated circuit which provides a digital-to-analog conversion scheme for efficiently converting digital signals corresponding to gray shades into analog signals for driving columns of the LCD display matrix.

2. Description of the Background Art

Active matrix LCD displays are used today in a variety of products, including hand-held games, hand-held computers, and laptop/notebook computers. These displays are available in both gray-scale and color forms, and are typically arranged as a matrix of intersecting rows and columns. The intersection of each row and column forms a pixel, or dot, the density and/or color of which can be varied in accordance with the voltage applied thereto in order to define the gray shades of the liquid crystal display. These various voltages produce the different shades of color on the display, and are normally referred to as "shades of gray" even when speaking of a color display.

It is known to control the image displayed on the screen by individually selecting one row of the display at a time, and applying control voltages to each column of the selected row. This process is carried out for each individual row of the screen. After each row has been selected, the process is repeated to refresh and/or update the displayed image.

LCD displays used in computer screens require a relatively large number of such column driver outputs. Color displays typically require three times as many column drivers as conventional "monochrome" LCD displays; such color displays usually require three columns per pixel, one for each of the three primary colors to be displayed. Thus, a typical VGA (480 rows×640 columns) color liquid crystal display includes 640×3, or 1,920 column lines which must be driven by a like number of column driver outputs.

The column driver circuitry is typically formed upon monolithic integrated circuits. Assuming that an integrated circuit can be provided with 192 column output drivers, then a color VGA display screen requires 10 of such integrated circuits (10×192=1,920). Due to the relatively large number of such column driver integrated circuits that are required by such a color VGA display screen, the cost of such column driver integrated circuits can greatly influence the overall cost of the display.

Integrated circuits which serve as column drivers, also known as source drivers, for active matrix LCD displays must generate different output voltages to define the various "gray shades" on a Liquid Crystal Display. These varying analog output voltages vary the shade of the color that is displayed at a particular point, or pixel, on the display. The computer, or other device used to control the video display, generates digital values that roughly correspond to the magnitude of the voltage to be applied at each pixel, and hence, the particular shade of color to be displayed at each pixel. However, the task of storing such digital values, converting such digital values into actual analog voltages, and driving the analog voltages onto the columns of the display matrix in the correct timing sequence is left to the column driver integrated circuits.

Known column driver integrated circuits typically require that the series of analog voltages corresponding to the various shades of gray be developed remotely from the integrated circuit. For example, one known integrated circuit column driver includes sixteen input terminals for receiving a series of sixteen different analog voltages that are generated off the chip. On board the integrated circuit, a 16:1 analog multiplexer is provided at the output of each column driver to select one of sixteen analog voltages to the output; thus, the sixteen analog voltages are simply passed directly by the analog multiplexer to the column driver output.

The known system described in the preceding paragraph is limited to only sixteen shades of gray for each color in the display. This method works extremely well for low numbers of voltages (2 to 16), but the number of required input voltages increases linearly with the number of output voltages needed. For high gray shade displays, which may require 256 or more distinct analog voltages, this method requires an equal number of input voltages and a great deal of system level space due to the routing of these voltages. In addition, these voltages must be generated externally, requiring another integrated circuit which must produce them. If more than sixteen shades are desired, the number of analog input voltages, and the size of each multiplexer provided at each output, must be increased. The number of input terminals of integrated circuit packages must be kept to a minimum in order to allow more of the package pins to be used for serving as column output drivers. Thus, the need to bring on-board, route, and multiplex a relatively large number of analog voltages is a distinct disadvantage.

Another technique is also known in the art for supplying a series of analog voltages to a column driver integrated circuit, but without requiring the dedication of a large number of input terminals to bring on-board the integrated circuit the array of analog voltages. In this second type of known integrated circuit, an external voltage generator provides only one analog voltage at a time; the external analog voltage generator is sequentially switched between a number of different analog voltages. For each column driven by the integrated circuit, the digital value corresponding to the desired shade of gray for that column is sequentially provided to the external voltage generator. Thus, the digital value for the first column is supplied to the external voltage generator, and the corresponding analog voltage is generated and supplied to the integrated circuit. A sample and hold circuit associated with the column driver output for the first column is enabled to sample the externally generated analog voltage. Next, the digital value for the second column is supplied to the external voltage generator, and the corresponding analog voltage is generated, and supplied to the integrated circuit. A sample and hold circuit associated with the column driver output for the second column is then enabled to retain the correct analog value for the second column. This process is repeated sequentially for each of the columns driven by the integrated circuit until the analog voltages for all 192 columns driven by one integrated circuit have been sampled and held.

In this second method described in the preceding paragraph, each output would sample the voltage and then hold it, using an amplifier to drive the output. This method requires that 1,920 sequential samples (192 columns per chip times 10 chips) be made during a single row time in a typical color display. Because of the number of column drivers, the external voltage generator must be able to switch rapidly in order to sample each column driver output in a given amount of time. The time required can be reduced somewhat by providing additional analog voltage inputs;

typically, there are a total of at least three voltage inputs containing the red, green, and blue voltages for color optimization on the display. When large displays with high numbers of gray shades are needed, this method requires extremely high speed, high power external digital-to-analog converter and associated amplifiers to drive these voltage inputs. However, external voltage generators capable of maintaining such rapid switching rates are more complex and expensive.

Accordingly, it is an object of the present invention to provide an integrated circuit column driver chip that is capable of generating a series analog output voltages, corresponding to varying shades of gray on the LCD display, locally on-board the integrated circuit column driver chip to thereby minimize the number of analog voltage input terminals, and to eliminate the need to generate such series of analog voltages externally from the integrated circuit.

It is another object of the present invention to provide such an integrated circuit which eliminates the need for a rapidly switching external analog voltage generator in order to generate the required series of analog voltages, corresponding to the varying shades of gray on the LCD display.

A further object of the present invention is to reduce the number of sampling cycles required on-board the column driver integrated circuit while still allowing all column driver outputs to sample their corresponding analog output voltage.

A still further object of the present invention is to decrease the number of such sampling cycles to a number that is less than the number of different shades of gray to be displayed upon the LCD display.

A yet further object of the present invention is to provide an analog voltage generator on-board such a column driver integrated circuit for generating a relatively large series of analog voltages corresponding to varying shades of gray on the LCD display.

Still another object of the present invention is to provide such a series of analog voltages which vary in a non-linear fashion when compared with the digital representations of the shades of gray to be displayed upon the LCD display.

These and other objects of the present invention will become more apparent to those skilled in the art as the description of the present invention proceeds.

SUMMARY OF THE INVENTION

Briefly described, and in accordance with a preferred embodiment thereof, the present invention relates, in one sense, to a monolithic integrated circuit for converting a digital input signal to an analog output signal, and including a counter responsive to a clocking signal for counting clock pulses, and having a plurality of output terminals for providing a counter output. In response to successive clock pulses, the counter sequences the counter output through a series of unique output patterns. An analog voltage generator provided on-board the integrated circuit is also responsive to the clocking signal for generating at least one, and preferably multiple, unique analog voltages for each different cycle of the clocking signal, and providing such unique analog voltages to one or more output terminals.

The integrated circuit also includes a comparator that is responsive to the digital input signal and to the counter output for generating a correlation signal indicating a correlation between the first digital input signal and the counter output; this correlation signal might serve, for example, to indicate that certain bits of the digital input signal match the current count held by the counter. A selection circuit is also included to provide, at an output port, an analog output signal corresponding to the first digital input signal. The selection circuit is coupled to the output terminal of the analog voltage generator for receiving the at least one analog voltage therefrom, and is further coupled to the comparator and is responsive to the correlation signal for selecting the at least one analog voltage to the first output port upon the generation of the first correlation signal.

The basic elements described thus far can be expanded whereby the present invention converts two or more digital input signals to analog output signals concurrently. In this regard, a first storage element can be included to store the first digital input signal, and a second storage element provided to store the second digital input signal. A second comparator is provided for comparing the second digital input signal to the current count of the counter. Likewise, a second selection circuit is provided to select the current analog voltage provided by the analog voltage generator whenever the second comparator generates a second correlation signal indicating a correlation between the second digital input signal and the counter output. This concept may be further extended up to any number of digital input signals, such as the 192 digital input signals representing the shades of gray for 192 column output drivers.

To reduce the number of consecutive counts that must be counted by the counter to ensure that all possible analog voltages have been generated, the analog voltage generator can provide two, four, or more separate analog voltages simultaneously for each cycle of the clock, and for each count of the counter. For example, if the counter counts 64 counting cycles, and if the analog voltage generator provides four different analog voltages for each cycle of the counter, then the analog voltage generator provides a total of 64 times 4, or 256 different analog voltages (or 256 different shades of gray) for each 64 counting cycles. Preferably, the analog voltages increase monotonically as the count is increased. Thus, the four analog voltages provided during the third counting cycle are all greater than the four analog voltages generated during the second counting cycle, and are all less than the four analog voltages generated during the fourth counting cycle.

In the case described in the preceding paragraph, the more significant bits of the first digital input signal are compared by the first comparator to the counter output in order to generate the first correlation signal, while the lesser significant bit(s) of the first digital input signal are used by the first selection circuit to select one of the two, four or more analog voltages that are simultaneously provided during the counter cycle when the first correlation signal is generated. Similarly, the more significant bits of the second digital input signal are compared by the second comparator to the counter output in order to generate the second correlation signal, while the lesser significant bit(s) of the second digital input signal are used by the second selection circuit to select one of the two, four or more analog voltages that are simultaneously provided when the second correlation signal is generated. In this manner, assuming that the integrated circuit contains 192 column drivers, further assuming that the clock is cycled through a count of 64, and further assuming that four analog output voltages are provided during each counter cycle, then all 192 column driver outputs can sample any of 256 different analog voltages over the course of only 64 counter cycles.

The preferred form of analog voltage generator includes a resistive divider network formed upon the integrated circuit and requiring only the supply of two reference voltages coupled to the opposing ends of the resistive divider network. The resistive divider network has at least N tap points therealong, wherein N corresponds to the number of cycles of the counter. The counter provides a series of N control terminals, only one of which is enabled or "high" for each counter cycle; for this purpose, the counter may include an N-stage shift register which simply shifts a logic "1" data bit consecutively through each of the stages of the shift register. A switching network is interposed between the N tap points of the resistive divider network and an output terminal of the analog voltage generator. The enabled control terminal of the counter enables the switching network to couple one of the N tap points to the output terminal of the analog voltage generator. Thus, after N counter cycles, N different analog voltages are provided to such output terminal. If desired, such N tap points may be arranged to provide a non-linear output characteristic whereby the change in voltage between first and second successive tap points is different from the change in voltage between the second and a third successive tap point.

As indicated above, it is advantageous to provide two, four, or more analog voltages during each counter cycle to increase the number of analog voltages that are generated over the course of the full cycling of the counter. In this case, the number of tap points of the resistive divider network is increased to, for example, 2 times N tap points. During each counter cycle, the enabled control terminal couples first and second consecutive tap points along the resistive divider network to first and second output terminals of the analog voltage generator. Thus, after N counter cycles, a total of 2 times N analog voltages have been made available for sampling to the column driver output circuits.

The aforementioned switching network may advantageously be provided by simple CMOS transistors, the number of such CMOS transistors corresponding to the number of tap points formed across the resistive divider network. In this event, the drain of each such transistor is coupled to a tap point of the resistive divider, the source of each such transistor is coupled to one of the output terminals of the analog voltage generator, and the gate terminal of each such CMOS transistor is coupled to one of the N control/output terminals of the N-stage shift register included within the counter.

DETAILED DESCRIPTION OF THE PREFERRED EMBODIMENTS

Figure 1:
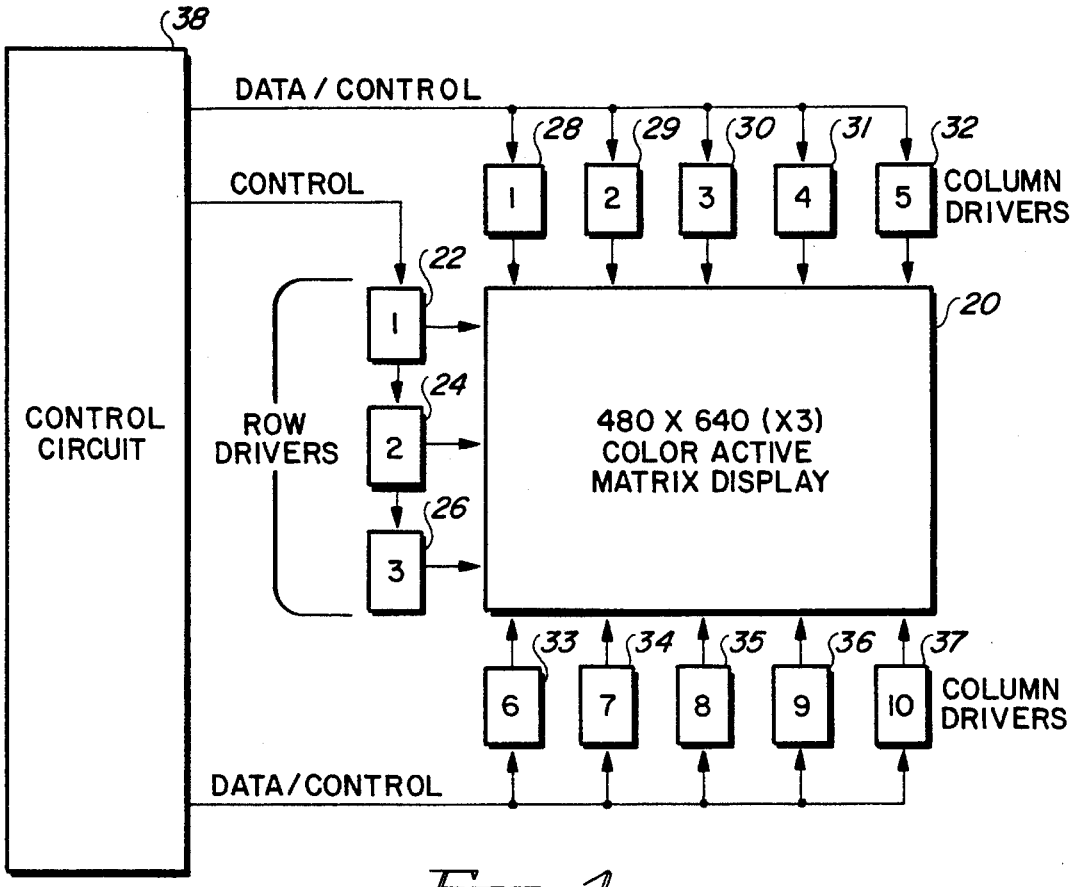
FIG. 1 is a block diagram of an active matrix LCD display including column and row driver circuitry and control circuitry for controlling the image displayed upon the LCD display.

Shown in FIG. 1 is a typical active matrix display system. The active matrix LCD display screen itself is designated by reference numeral 20 and may include 480 rows and 640 columns for a typical black and white gray-scale LCD display. The intersection of each row and each column is called a pixel, and a thin film transistor (TFT) is provided at each such intersection to selectively couple the voltage on each column to a storage capacitor at each pixel when each row is selected. The intensity of each pixel is selected by controlling the voltage applied to the storage capacitor at each pixel of the display. For a color LCD display, there are three times the number of columns to provide for three primary colors at each pixel of the screen.

During each refresh cycle of the display, each of the 480 rows is successively selected by row drivers 22, 24, and 26 for enabling the thin film transistors in the selected row and allowing the voltages present on the 640 columns to be stored upon the storage capacitors at each of the 640 pixels in the selected row. As shown in FIG. 1 ten column driver integrated circuits 28–37 each drive 64 of the 640 columns in the black and white LCD display (or 3 times 64, or 192 columns, for a color display). A control circuit 38 provides data and control signals to the row drivers 22–26 and column drivers 28–37 to synchronize such components in order to display a desired image. The basic drive circuitry shown in FIG. 1 is known in the art and does not itself form a part of the present invention.

Figure 2:
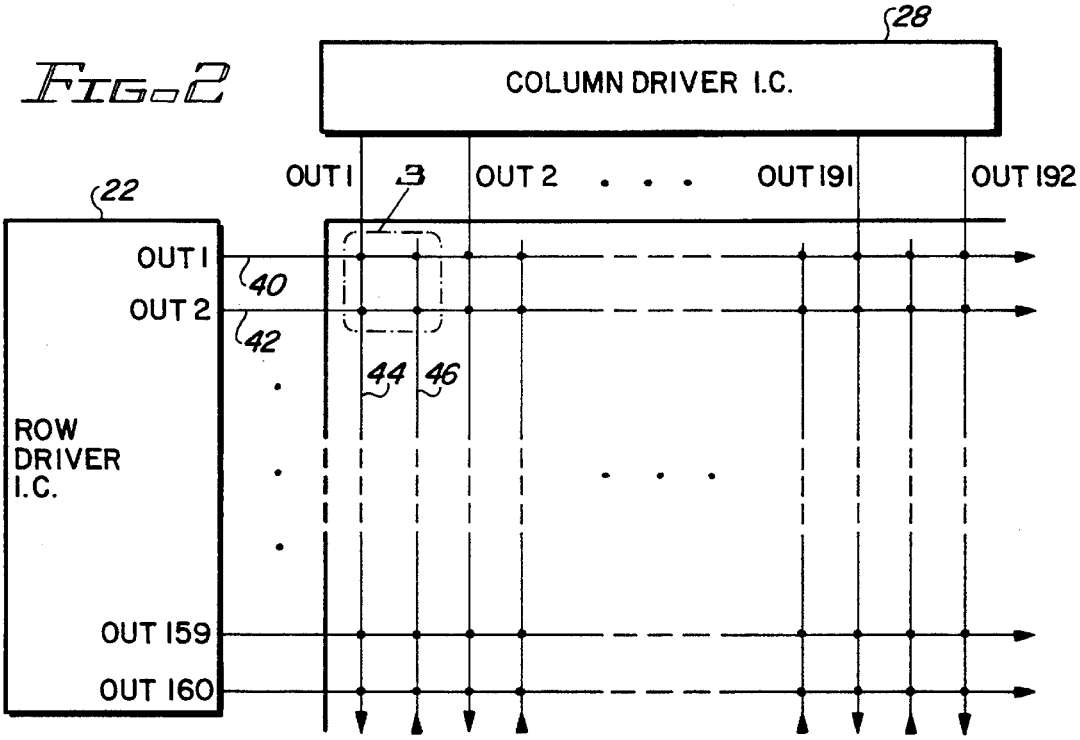
FIG. 2 is a more detailed block diagram of a portion of FIG. 1 including one column driver integrated circuit, one row driver integrated circuit, and several of the row and column conductors of the act e matrix display.

Referring to FIG. 2, row driver integrated circuit 22 and column driver integrated circuit 28 are shown driving 160 rows and 192 columns, respectively, of an active matrix color display. The rows and columns intersect each other to define pixels at the intersection points thereof. Four such intersection points are shown within the dashed block labeled FIG. 3. Rows 1 and 2 are formed by conductors 40 and 42, respectively. Column 1 is formed by conductor 44 and is driven by column driver integrated circuit 28; an adjacent column is formed by conductor 46 which is driven by column driver integrated circuit 33 (see FIG. 1).

Figure 3:
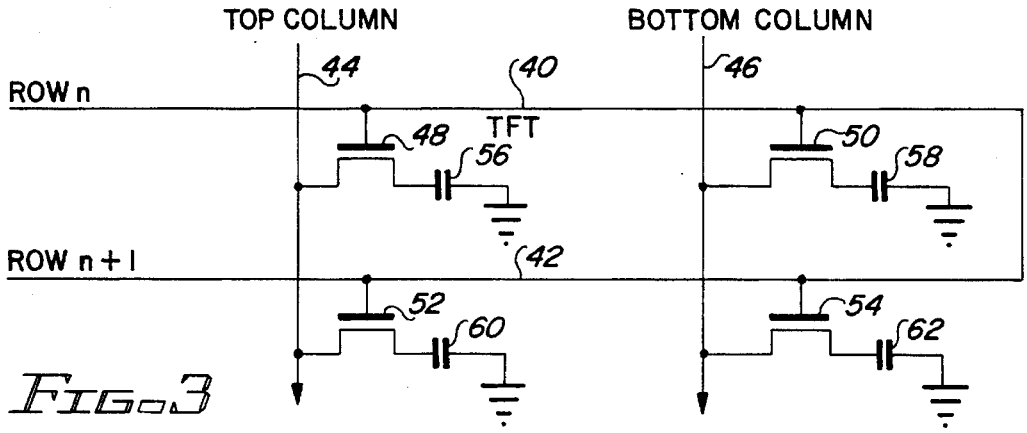
FIG. 3 is an enlarged drawing of the small portion of the active matrix display surrounded in dashed outline in FIG. 2, and showing the thin film transistors and sampling capacitors formed upon the display matrix.

Within FIG. 3, the portion of the active matrix LCD display formed by the intersection of row conductors 40 and 42 and column conductors 44 and 46 is shown in greater detail. As shown in FIG. 3, row conductor 40 is coupled to the gate terminals of two MOS thin-film transistors (or TFTs) 48 and 50. Likewise, row conductor 42 is coupled to the gate terminals of two thin-film transistors 52 and 54. Column conductor 44 is coupled to the drain terminals of transistors 48 and 52, and column conductor 46 is coupled to the drain conductors of transistors 50 and 54. When the pixels formed at the intersection of row conductor 40 and column conductors 44 and 46 are to be updated, row conductor 40 is driven high to enable TFTs 48 and 50; in this instance, the column driver output voltage applied to column conductor 44 is applied through enabled TFT 48 to storage capacitor 56 for storing the analog voltage corresponding to the desired gray shade for such pixel. Similarly, the column driver output voltage applied to column conductor 46 is applied through TFT 50 to storage capacitor 58 for storing the analog voltage corresponding to the desired gray shade for such pixel. When row conductor 40 is returned low, TFTs 48 and 50 are turned off, and the analog voltages applied to storage capacitors 56 and 58 are retained until they are updated by a subsequent refresh cycle. Row conductor 42 is then enabled, and the analog voltages applied to column conductors 44 and 46 are updated to apply the desired gray shade voltages to be stored on storage capacitors 60 and 62, respectively.

Figure 4:
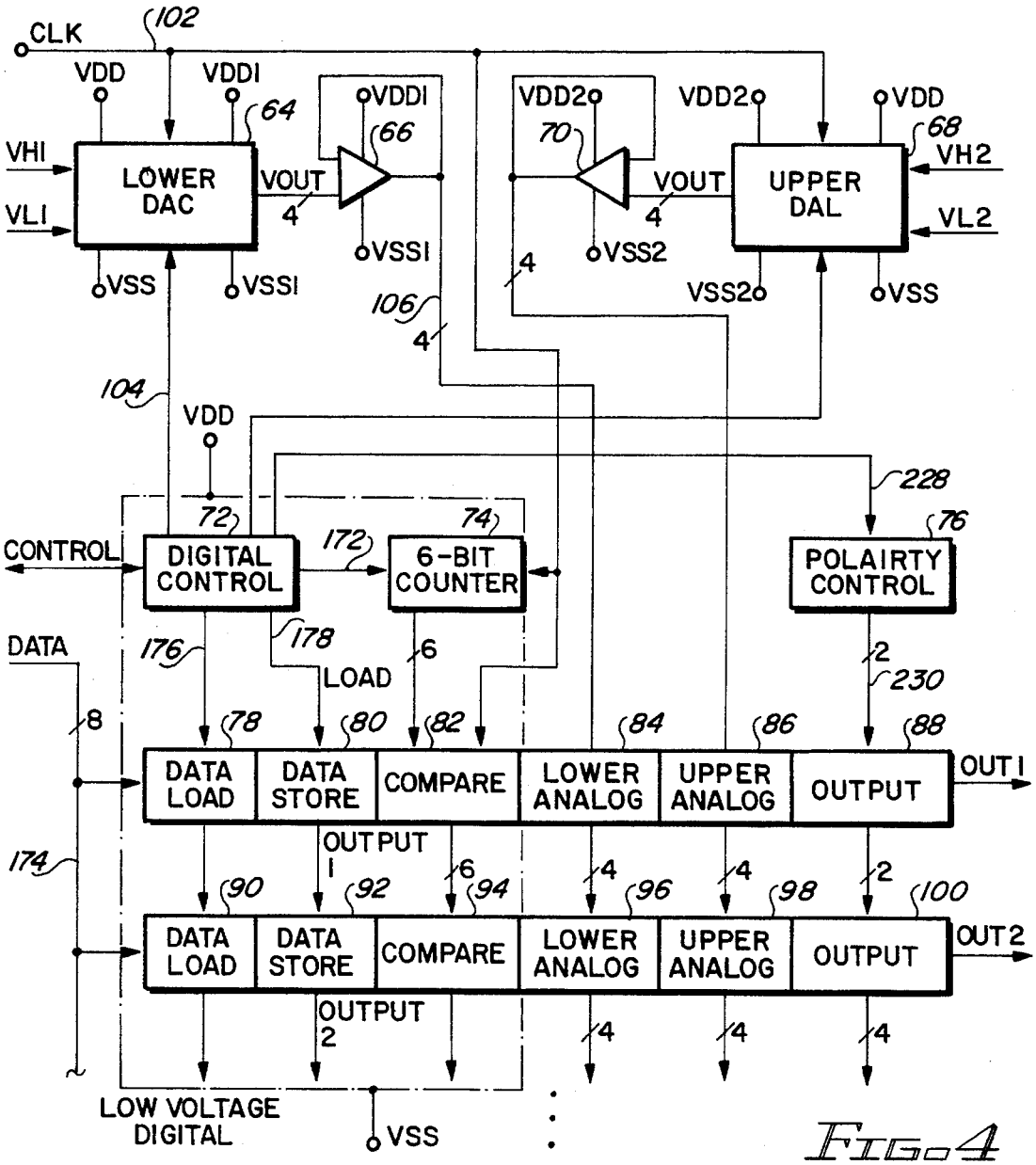
FIG. 4 is a block diagram showing a preferred embodiment of a column driver integrated circuit incorporating the present invention.

In FIG. 4, a preferred circuit is shown in block diagram form for generating the various analog output voltages that must be provided to the column driver output terminals of the column driver integrated circuit during the selection of each row of the display. Certain portions of the circuitry indicated within FIG. 4 are shared by all 192 column output driver sections, while other portions of the circuitry indicated in FIG. 4 are unique to each column driver output section. First, with respect to the circuit blocks that are shared by all 192 column driver output sections are Lower DAC block 64 and its buffer amplifier 66, Upper DAC block 68 and its buffer amplifier 70, digital control block 72, six-bit counter 74, and polarity control block 76. On the other hand, the circuit blocks that are unique to the first column driver output section include data load block 78, data store block 80, six-bit comparator block 82, lower analog sampling block 84, upper analog sampling block 86, and output multiplexer 88. Within FIG. 4, a second column driver output section is shown and includes data load block 90, data store block 92, six-bit comparator block 94, lower analog sampling block 96, upper analog sampling block 98, and output multiplexer 100.

The basic function of the column driver integrated circuit shown in FIG. 4 can be described as a parallel combination of 9-bit digital-to-analog converters. Each column output section shown in FIG. 4 produces the response of an individual 9-bit digital-to-analog converter. Eight bits of data are used to select one of 256 voltages produced by either Lower DAC block 64 or Upper DAC block 68. Global polarity control 76 is used to control output multiplexers 88 and 100 to select between the lower analog output voltages saved in lower analog blocks 84 and 96 or the upper analog output voltages saved in the upper analog sampling blocks 86 and 98. This polarity control could also be provided individually, rather than globally; for example, the data words stored by each of the data store blocks could include a ninth data bit, making it possible to select the upper or lower analog sampling block voltages independently in each output.

In order to achieve a wide-ranging analog output voltage for each column driver output while using a low-voltage CMOS process, some of the circuit elements shown in FIG. 4 are actually duplicated at two different power supply ranges. For example, Lower DAC block 64 and Upper DAC block 68 both serve to generate analog output voltages in an identical fashion, except that the analog voltages generated by Lower DAC block 64 are at a lower power supply range than those generated by Upper DAC block 68. Likewise, the lower analog sampling block 84 and the upper analog sampling block 86 function identically to each other, with the exception that they operate at two different power supply ranges and the further exception that lower analog sampling block 84 samples voltages generated by Lower DAC block 64, while upper analog sampling block 86 samples voltages generated by Upper DAC block 68. The reasons for duplicating the DAC blocks and analog sampling blocks are explained in detail within co-pending patent application Ser. No. 08/183,036, filed on even date herewith, and assigned to the assignee of the present application; the text and drawings of such co-pending patent application are hereby incorporated by reference into this patent application specification.

Lower DAC block 64 receives several power supply voltages, including VSS (nominally 0 volts, or ground potential), VDD (nominally +5 volts), VDD1 (nominally +8 volts), and VSS1 (nominally ground potential). Lower DAC block 64 also receives two regulated reference voltages generated externally from the column driver integrated circuit and supplied via input terminals thereto, namely VH1 and VL1. These reference voltages may be set by the user at desired voltage levels. Voltage VH1 is typically set below power supply voltage VDD1, for example, at +5.5 volts; voltage VL1 is typically set above power supply voltage VSS1, for example, at +1.5 volts. As indicated in FIG. 4, Lower DAC block 64 includes an input terminal for receiving a clocking signal presented on conductor 102. In addition, Lower DAC block 64 receives a Start Low signal from digital control block 72 via conductor 104. As further indicated in FIG. 4, Lower DAC block has four VOUT analog output terminals which provide four analog output voltages to buffer amplifier 66 which buffers and recreates such analog output voltages from a lower impedance source in order to drive the four lower analog output conductors collectively identified as 106 in FIG. 4 for coupling to each of the 192 lower analog sampling blocks formed within the integrated circuit, including 84 and 96.

Figure 6:
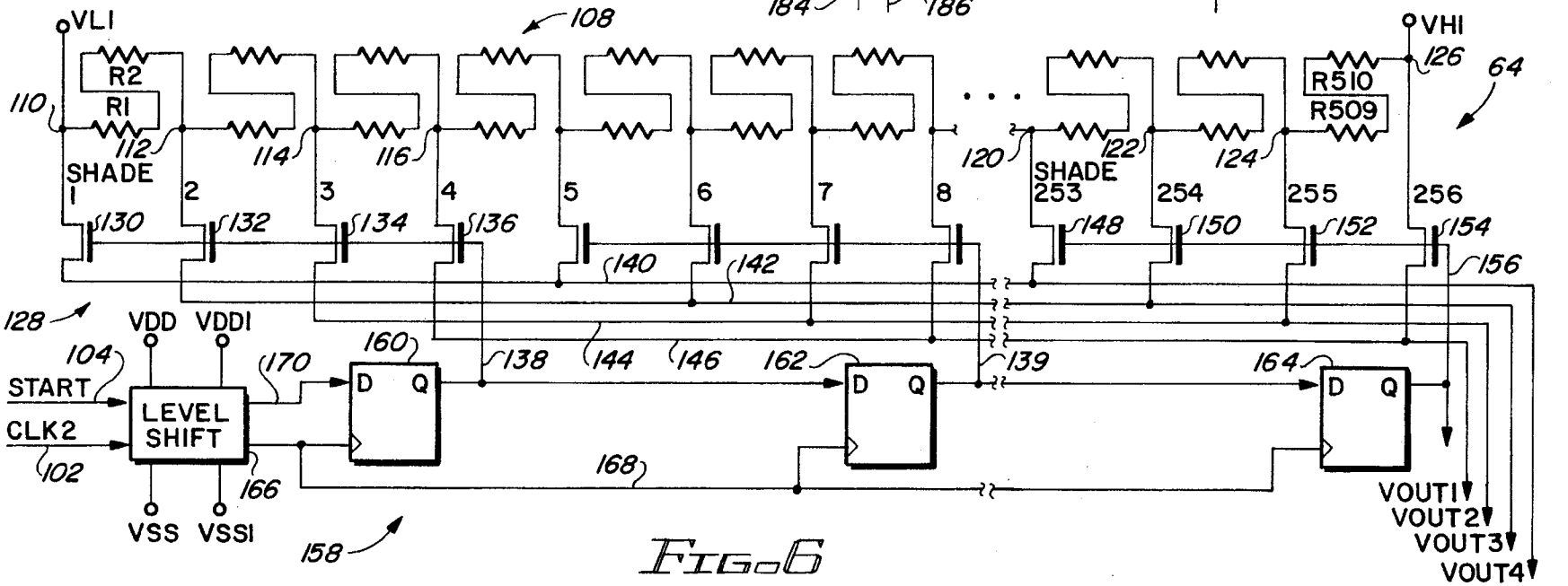
FIG. 6 is a schematic drawing of an analog voltage generator, or digital-to-analog converter, including a resistive divider network and a 64-stage shift register.

The specific construction of Lower DAC block 64 is shown in FIG. 6. Lower DAC block 64 is capable of generating, in the manner described below, a total of 256 different analog voltages; accordingly, Lower DAC block could be considered equivalent to an 8-bit D/A converter. As shown in FIG. 6, Lower DAC block 64 includes a resistive divider network 108 which, in the preferred embodiment, is formed by 510 equal-valued resistors connected in series between reference voltages VL1 and VH1. The VL1 and VH1 reference voltages are selected to set the lower half of the desired gray shade voltage range; the upper half of the desired gray shade voltage range is set by VL2 and VH2, which are coupled to Upper DAC 68. While 510 resistors are sufficient, the number of such resistors can be increased further to allow for even greater refinement of the analog voltages to be generated.

Various points along resistive divider network 108 are tapped to provide a total of 256 different analog voltages. For example, the first such tap point is designated by reference numeral 110 in FIG. 6 and corresponds to the reference voltage VL1. The second tap point in succession is designated by reference numeral 112 and is formed at the intersection of the second and third resistors in divider network 100. The third and fourth tap points are designated by nodes 114 and 116. At the opposite end of divider network 108, the last four tap points (i.e. the 253rd, 254th, 255th, and 256th tap points) are designated by reference numerals 120, 122, 124, and 126, respectively, wherein the 256th tap point 126 corresponds to the reference voltage VH1.

The aforementioned tap points are accessed in successive groups of four tap points by an array 128 of MOS transistors. For example, tap points 110, 112, 114, and 116 can be accessed as a group by four corresponding MOS transistors 130, 132, 134, and 136, illustrated an n-channel transistors. The gate terminals of transistors 130, 132, 134, and 136 are commonly coupled to a control conductor 138 which simultaneously enables or disables such transistors. Assuming that control conductor 138 is "high" and enabled, then transistor 130 couples the analog voltage at tap point 110 onto analog voltage conductor 140 (VOUT1). Similarly, transistors 132, 134, and 136 serve to couple the analog voltages at tap points 112, 114, and 116 onto analog voltage conductor 142 (VOUT2), analog voltage conductor 144 (VOUT3), and analog voltage conductor 146 (VOUT4), respectively.

In a similar fashion, the gate terminals of transistors 148, 150, 152, and 154 are commonly coupled to control conductor 156. Assuming that control conductor 156 is "high" and enabled, then transistors 148–154 simultaneously couple the four analog voltages at tap points 120–126 onto analog voltage conductors 140–146, respectively. The array of MOS transistors 128 may thus be considered to form a switching network coupled to the tap points of resistive divider network 108 for selectively coupling successive analog voltages provided at corresponding successive tap points to analog output terminals of Lower DAC block 64.

Control conductors 138 and 156 are two of a total of 64 such control conductors. Thus, by individually enabling the 64 control conductors, 64 groups of four analog voltages are presented to analog voltage conductors 140–146, for a total of 256 unique analog voltages. During the time that any given control conductor is enabled, the four analog voltages that are presented to analog voltage conductors 140–146 are separated from each other by one gray shade voltage. Moreover, assuming that the enablement of the control conductors is sequenced to first enable control conductor 138, next control conductor 139, and so forth, until finally enabling control conductor 156, then the analog voltages presented to analog voltage conductors 140–146 will monotonically increase from reference voltage VL1 to reference voltage VH1. Of course, the control conductors could also be sequenced in the opposite direction, if desired, in which case the analog voltages presented to analog voltage conductors 140–146 will monotonically decrease from reference voltage VH1 to reference voltage VL1.

Within the embodiment described above in conjunction with FIG. 6, the analog voltages generated by Lower DAC block 64 change in a linear fashion, consistent with a typical 8 bit D/A. This is because all of the resistors in resistive divider network 108 are equal-valued, and because the same number of such resistors (i.e., two) separate each of the adjacent tap points. However, in some instances, it may be desired to generate analog output voltages which change monotonically, but in a non-linear fashion. This is important for an LCD driver because the actual shade of color seen on the display does not have a linear relationship to the voltage at which the display must be driven. For example, certain LCD displays may require unequal increments in voltage in order to display comparable increments in shade, color or brilliance. In this regard, the number of equal-valued resistors shown in FIG. 6 can be increased, and the tap points can be altered such that, for example, three resistors separate two adjacent tap points in one portion of the divider network, but only two resistors separate two adjacent tap points in a different portion of the divider network. In this case, for example, the voltage drop between a first and a second successive tap point may differ from the voltage drop between a third and a fourth successive tap point. The number of resistors can easily be increased to more than 510 to achieve even greater accuracy and selection of any non-linear voltage characteristic required to match the LCD display characteristics, while still generating a total of only 256 distinct analog voltages.

As described above, the enablement of the control conductors 138, 139 and 156 is preferably sequenced so that only one such control conductor is enabled at a time, and so that the analog voltages generate change in a monotonic manner. For this purpose, Lower DAC block 64 also includes a clocked 64-stage shift register 158 shown in FIG. 6. Shift register 158 includes a series of 64 serially-chained flip-flops, including flip-flops 160, 162 and 164. The Q output terminal of flip-flop 160 serves as a control terminal for selectively enabling control conductor 138. The Q output terminal of flip-flop 160 also serves as the Data input to second flip-flop 162. In turn, the Q output terminal of flip-flop 162 serves as a control terminal for selectively enabling control conductor 139, as well as the Data input to the next succeeding flip-flop (not shown). Finally, the Q output terminal of 64th flip-flop 164 serves as a control terminal for selectively enabling control conductor 156.

Referring briefly to FIG. 4, it will be recalled that Clock conductor 102 is coupled to Lower DAC block 64. However, the 64 flip-flops (including flip-flops 160, 162, and 164) that form shift register 158 are operated from the lower VDD1/VSS1 power supply range, rather than from the conventional VDD/VSS CMOS power supply range. Accordingly, the Clock signal is level-shifted by Level Shift block 166 in FIG. 6 to provide a level-shifted clocking signal on conductor 168 which is coupled to the clock input terminals of each of the 64 flip-flops of shift register 158.

It will also be recalled from FIG. 4 that Lower DAC block 64 receives a Start Low signal from digital control block 72 via conductor 104. Once again, it is necessary to level-shift the Start Low signal, and as shown in FIG. 6, Level Shift block 166 receives the Start Low signal from conductor 104 and provides a level-shifted Start signal on conductor 170 which, in turn, is coupled to the Data input terminal of first flip-flop 160.

Digital Control block 72 (see FIG. 4) generates the Start Low signal as a positive pulse when it is time to begin the digital-to-analog conversion process. Once the Start Low signal is pulsed, a logic "1" level is clocked into flip-flop 160 of shift register 158 on the next occurrence of the Clock signal to enable control conductor 138. The Start Low Signal is returned to a logic "0" level before the occurrence of the next Clock signal, and accordingly, a logic "0" is clocked into flip-flop 160 on the next clock cycle to return control conductor 138 to a low level. The logic "1" level that was initially clocked into flip-flop 160 is clocked into flip-flop 162 to enable control conductor 139. Only one flip flop output will be high at a time. This process is repeated for 64 clock cycles until a logic "1" level is clocked into flip-flop 164, and control conductor 156 is enabled. On the next clock cycle, a logic "0" is clocked into flip-flop 164, control conductor 156 returns low, and none of the MOS transistors in array 128 are enabled. Shift register 158 may be considered as a counter as it counts 64 clock cycles. While shift register 158 is shown as shifting data in only a single direction (i.e., from flip-flop 160 toward flip-flop 164), those skilled in the art will appreciate that shift register 158 could, if desired, be made as a bidirectional shift register to allow the analog output voltages to be stepped in either direction.

During each of the aforementioned 64 clock cycles, four transistors, or transmission gates, are turned on for passing four gray shade voltages produced by resistive divider 108 to outputs VOUT1–VOUT4. With each further transition of the Clock, a new set of four gray shade voltages is passed to outputs VOUT1–VOUT4, until all 256 gray shade voltages have been provided.

Lower DAC block 64 is unique in several ways when compared with known digital-to-analog converters. First, Lower DAC block 64 does not receive an 8 bit digital input value to generate the 256 output voltages like known digital-to-analog converters. The digital-to-analog conversion scheme used within the integrated circuit described herein allows the necessary analog voltages to be generated in a monotonically increasing (or decreasing) manner over the entire range of such analog voltage values. In other words, the generated analog output voltages only step in a single direction from start to finish. The clock signal is sufficient to determine when to transition to the next state, and the Start Low signal is needed only to initialize the process.

Before further describing the circuitry shown in FIG. 4, it may first be helpful to define some terms. As used herein, a "row update cycle" refers to the period of time required to update the pixels in a single row of the LCD display. Thus, an LCD display having 480 rows requires 480 row update cycles to update all of the pixels in the display.

Another term used herein is a data clock cycle, indicating the time required to apply one eight-bit digital word to a Data Bus and to save such data word in its corresponding data load block. All 1,920 data load blocks (contained on all ten column driver integrated circuits) are updated during each row update cycle; consequently, there may be as many as 1,920 data clock cycles during each row update cycle.

Figure 7:
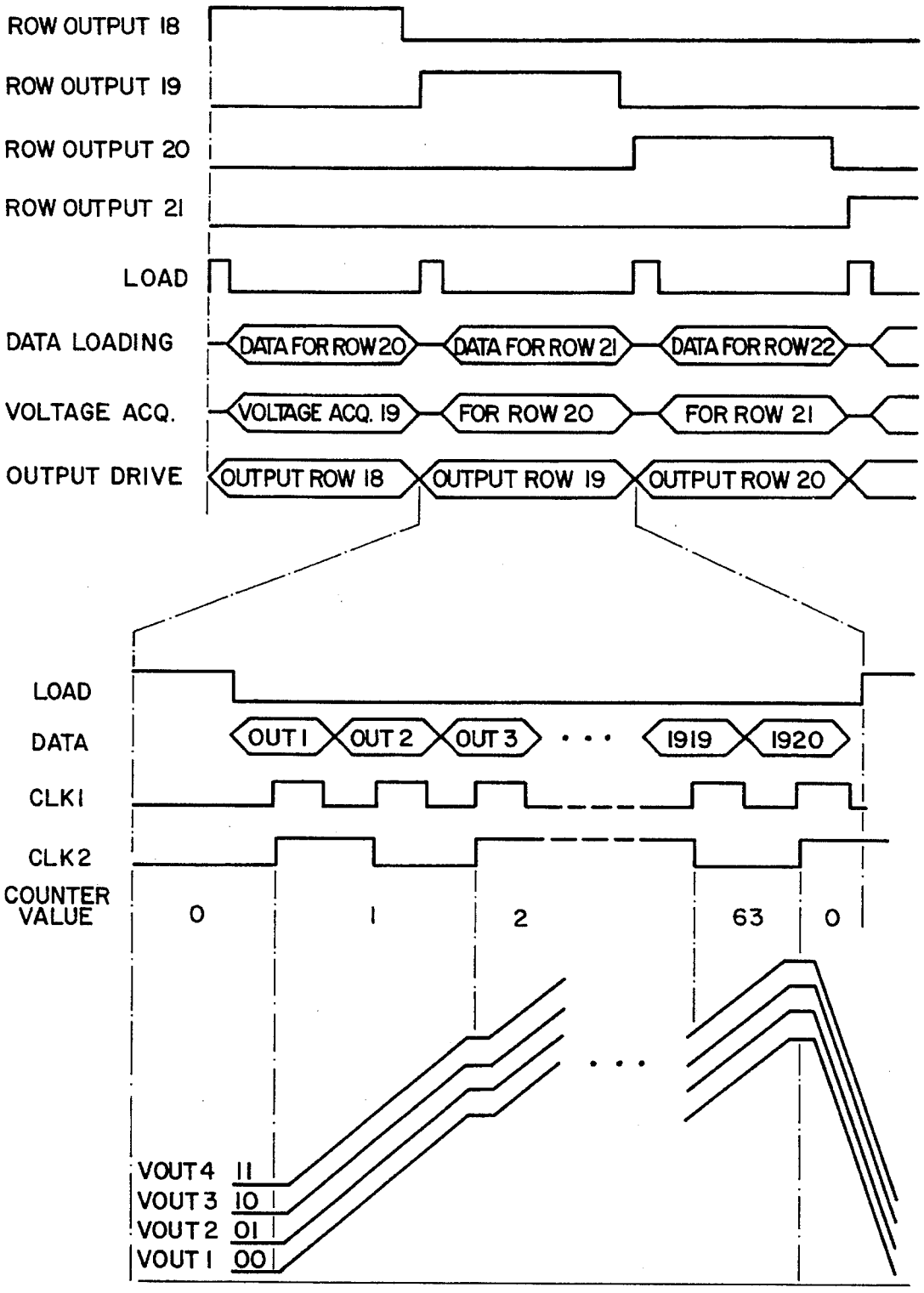
FIG. 7 is a timing diagram showing, in the upper half thereof, three consecutive row selection periods, and in the lower half, the digital-to-analog conversion process which occurs during each row selection period.

FIG. 7 is a timing diagram that helps to explain the timing of various operations performed by the circuit blocks shown in FIG. 4. In particular, FIG. 7 helps to explain the pipelined nature of the operations performed by a column driver integrated circuit constructed in accordance with the teachings of the present invention. The upper half of FIG. 7 shows three successive row update cycles. In the first row update cycle, row 18 of the LCD display is being updated, analog voltages for row 19 are being generated and saved, and digital data for row 20 is being entered. In the second row update cycle, row 19 of the LCD display is being updated, analog voltages for row 20 are being generated and saved, and digital data for row 21 is being entered. Finally, in the third row update cycle, row 20 of the LCD display is being updated, analog voltages for row 21 are being generated and saved, and digital data for row 22 is being entered.

The lower half of FIG. 7 helps to explain operations which occur during each row update cycle, including the entry of new digital data and the generation of analog voltages. As indicated, new digital data is entered serially during each row update cycle for all 1,920 data values corresponding to the 1,920 columns in each row of a color LCD display. Entry of such data is synchronized by a clocking signal labelled "CLK1" which pulses at least 1,920 times during each row update cycle to define 1,920 data clock cycles. With each negative transition of CLK1, a new digital data word is broadcast over the Data Bus to load the next digital work into the appropriate data load block. Also shown in FIG. 7 is the clocking signal CLK2 which clocks both the shift register in Lower DAC block 64 as well as the binary counter 74. Also shown in the lower half of FIG. 7 are the four analog voltages VOUT1–VOUT4 generated by Lower DAC block 64 in response to successive pulses of clocking signal CLK2.

Those skilled in the art will appreciate that the frequency of clocking signal CLK2 can be much less than the frequency of CLK1, allowing plenty of time for analog voltages VOUT1–VOUT4 to ramp up and stabilize before being held by the track/hold blocks within the various column driver output sections. Accordingly, there is no need for analog voltages VOUT1–VOUT4 to switch rapidly. Moreover, because the analog voltages VOUT1–VOUT4 increase or decrease monotonically, the magnitude of the change in voltage by which VOUT1–VOUT4 must ramp up or down between successive pulses of CLK2 is again minimized. Finally, because such analog voltages are generated in groups of four, rather than as a single analog voltage, the number of clock cycles of CLK2 during each row update cycle, and hence the number of times each signal must ramp up or down during each such row update cycle, is also minimized.

Returning to FIG. 4, 6-Bit Counter 74 is a conventional six-bit binary counter which counts from 0 to 63 (or, in binary, from 000000 to 111111). Counter 74 is coupled to clock conductor 102 for receiving the Clock signal and increments with each pulse or transition of the Clock signal. Circuitry for providing such a digital up-counter is well known to those skilled in the art, and is described, for example, within Chapter 4 of *Digital Circuits and Microprocessors*, by Herbert Taub, McGraw Hill, 1982, hereby incorporated herein by reference.

Digital control block 72 is coupled to counter 74 by conductor 172 for periodically resetting counter 74 each time that the Start Low signal triggers shift register 158 of Lower DAC block 64. The object is to synchronize counter 74 with shift register 158. When shift register 158 enables control conductor 138, the output of counter 74 is "000000". When shift register 158 enables control conductor 139, the output of counter 74 is "000001"; likewise, when shift register 158 finally enables control conductor 156, the output of counter 74 is "111111". In this sense, shift register 158 and binary counter 74 may be considered a single counting means.

As indicated earlier, the principal objective of a column driver integrated circuit is to provide the analog gray shade voltages to be driven onto the columns of the display matrix in accordance with digital representations of such shades of gray. Thus, before the integrated circuit can output the analog voltages, it must first receive the digital representations of such gray shade values. The circuitry for acquiring such values for a selected row of the LCD display will be described below in conjunction with FIGS. 4 and 5.

As shown in FIG. 4, the column driver integrated circuit receives eight bits of data on an 8-bit wide Data Bus 174. The source of such data may be from a personal computer video display board or the like. For purposes of explanation, it will be assumed that the loading of data into the data load blocks during the first row update cycle corresponds to the data that will ultimately be driven onto the column driver outputs when row 20 of the LCD display is updated, as indicated in the timing diagram of FIG. 7. However, because of the pipelined nature of operation of the column driver integrated circuit, the column driver outputs are, during the first row update cycle, actually providing the column output voltages for row 18. It will not be until two more row update cycles, or the third row update cycle, before the column driver outputs are ready to provide the LCD display with the analog column voltages corresponding to row 20.

Data Bus 174 is coupled to each of the 192 data load blocks included in the column driver integrated circuit, including data load blocks 78 and 90 shown in FIG. 4. Digital control block 72 generates control signals, collectively designated by reference numeral 176 within FIG. 4, which are coupled to each of the 192 data load blocks within one column driver integrated circuit, and which serve to address one of the 192 data load blocks at any given time. Such control signals indicate to a particular data load block, such as data load block 90, that the eight-bit data word on Data Bus 174 during the present data clock cycle (as defined by CLK1 in FIG. 7) is the data corresponding to the gray shade value to be driven onto the second column of the LCD matrix for a row of the LCD matrix that will soon be updated. Accordingly, when each such data load block is addressed by control signals 176, the eight-bit data value on Data bus 174 is entered into the data load block. Clock signal CLK1 pulses again, a new eight-bit data word is then applied to Data bus 174, and the next data load block is addressed to save the new eight-bit data word. This process is continued until all 192 data load blocks of the integrated circuit (and all 1,920 data load blocks contained on 10 such integrated circuits) have been updated. The data load blocks are merely conventional CMOS clocked latches. Circuitry for providing such clocked latches is well known to those skilled in the art, and is described, for example, at pages 136–137 of *Digital Circuits and Microprocessors*, by Herbert Taub, McGraw Hill, 1982.

At the beginning of the second row update cycle (see FIG. 7), digital control block 72 generates a LOAD signal on conductor 178 which simultaneously causes all of the data load blocks to transfer their contents to the data store blocks, including data store blocks 80 and 92. Once again, data store blocks are formed as conventional CMOS clocked latches. Thus, during this second row update cycle, the data required for row 20 is now transferred into the data store blocks. Also during this second row update cycle, the data for row 21 will be driven onto Data bus 174 and selectively entered into the data load blocks over the course of the second row update cycle.

After the LOAD signal on conductor 178 is pulsed, and after the data store blocks are loaded with the data for row 20, digital control block 72 generates the Start Low signal to initiate the cycling of Lower DAC block 64. Likewise, digital control block 72 causes counter 74 to be reset following receipt of the next clock pulse to synchronize counter 74 to shift register 158 of Lower DAC block 64. In this manner, digital control block 72 serves to synchronize the initial count of "000000" in the binary counter with the beginning of the serial shifting of the data bit through the 64 stages of shift register 158.

Figure 5:
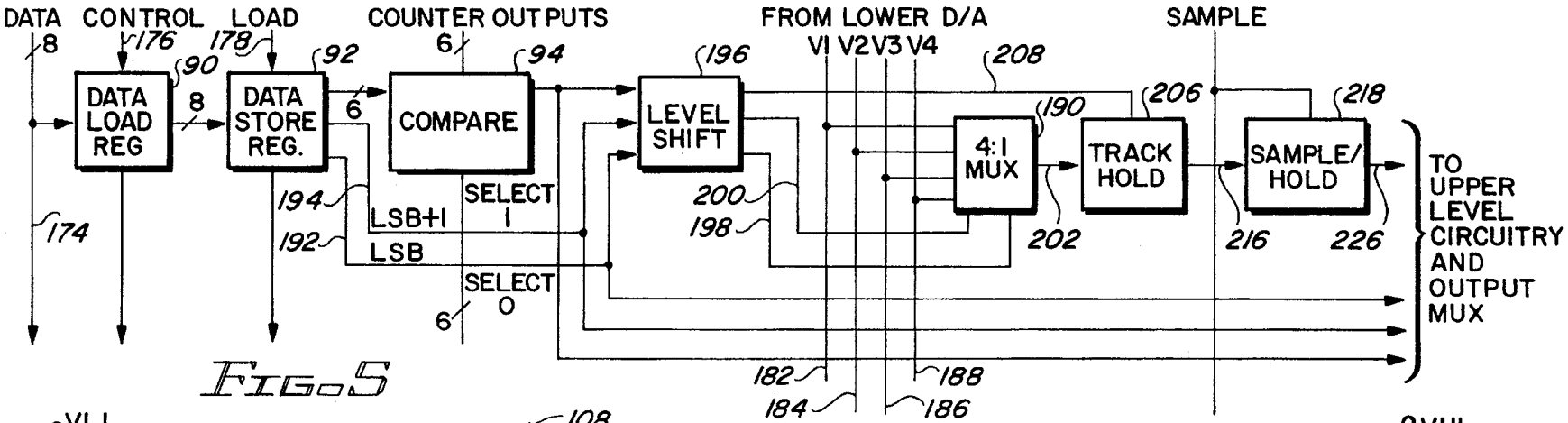
FIG. 5 is a block diagram showing in greater detail a portion of FIG. 4 corresponding to the data path for one column driver output.

As Lower DAC block 64 begins to generate the 256 analog voltages, each column driver circuit must acquire the correct analog voltage during one of the 64 shift register cycles. The manner by which this is done will now be explained in conjunction with FIG. 5. Within FIG. 5, a portion of the column driver output section for the second column driver output (OUT2) is shown in greater detail. It should be noted, however, that FIG. 5 is a simplified illustration of the circuit elements within one of the 192 column driver output sections, showing only the common digital circuitry and the lower analog region circuitry; the upper analog region circuitry, and the output multiplexer have been omitted for clarity. The upper analog region circuitry operates in an identical manner to that now to be described for the lower analog circuitry.

Figure 8:
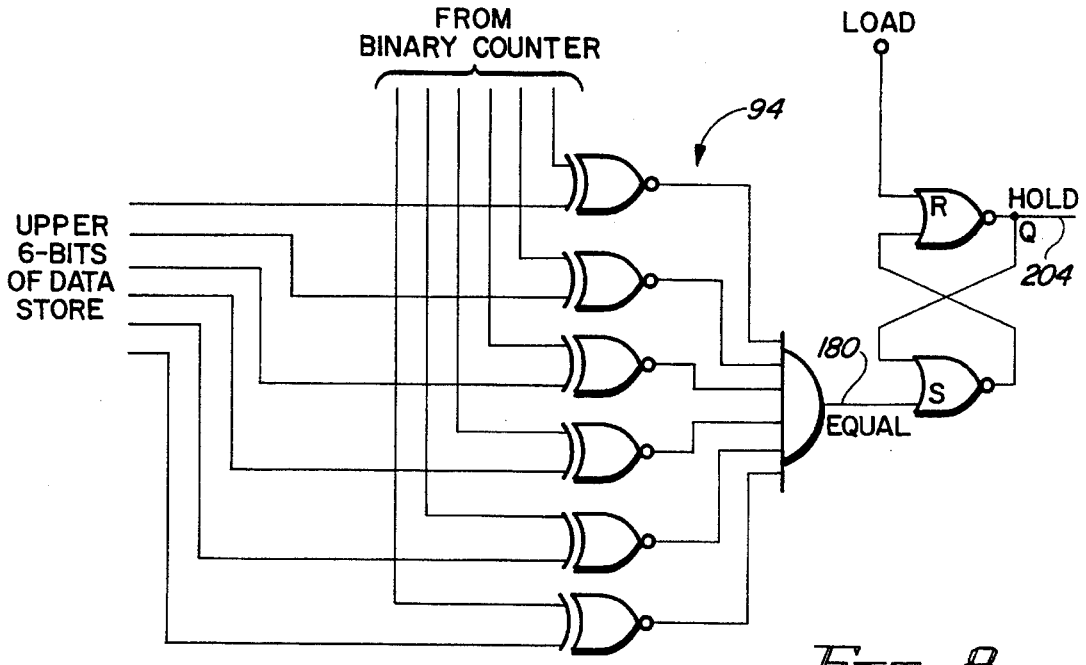
FIG. 8 is a logic diagram for a six-bit comparator shown in FIG. 5.

Each column driver output section includes a six-bit comparator such as comparator 94 for the second column driver output section. The specific configuration of comparator 94 is shown in FIG. 8. As indicated in FIGS. 5 and 8, comparator 94 compares the current six-bit count of binary counter 74 to the upper, or most-significant, six bits of the eight-bit digital word stored in data store block 92. This comparison may be made by six Exclusive-Nor gates, the outputs of which are ANDed together, as shown in FIG. 8, to provide an EQUAL signal on conductor 180; this EQUAL signal can be considered to be a correlation signal indicating a correlation between the data word stored and the status of counter 74 and shift register 158.

If comparator 94 determines that there is a match, then one of the four analog voltages currently being provided as VOUT1–VOUT4 by Lower DAC 64 and buffer amplifier 66 is the analog voltage to be selected for the second column of row 20. The four buffered analog output signals provided by buffer amplifier 66 are shown in FIG. 5 as conductors 182 (V1), 184 (V2), 186 (V3), and 188 (V4). These four analog output signals are coupled to a 4:1 multiplexer 190 within the lower analog block 96 of the second column output driver section. Multiplexer 190 serves to select one of the four analog voltages V1–V4 in accordance with the two least significant bits of the digital word stored in data store block 92. However, data store block 92 is a register powered from conventional power supply lines VDD/VSS, whereas multiplexer 190 is powered from lower power supply lines VDD1/VSS1. Accordingly, as shown in FIG. 5, the two least significant bits are routed over conductors 192 and 194 to level shift block 196 to provide level-shifted versions of such signals on conductors 198 and 200, respectively. Conductors 198 and 200, corresponding to the two least significant bits of the eight-bit stored data word, are coupled to multiplexer 190 for selecting one of the four current analog output voltages V1–V4 onto output conductor 202 ("00"=V1, "1"=V2, "10"=V3, and "11"=V4).

Of course, the output of multiplexer 190 will change as soon as Lower DAC block 64 receives the next Clock pulse (CLK2 in FIG. 7), so it is necessary to save the selected analog voltage before the end of the current CLK2 clock cycle. Referring to FIG. 8, the initial occurrence of the Load signal at the beginning of each row update cycle causes the Hold signal output on conductor 204 by comparator 94 to be reset to a low level. The Hold signal does not get set to a high level until the EQUAL signal is generated on conductor 180, indicating a match. Thus, the Hold signal starts low at the beginning of each row update cycle, and stays low until a match occurs, at which time the Hold signal goes high.

The aforementioned Hold signal generated by comparator 94 is used to save the desired analog output voltage in a track/hold block 206 shown in FIG. 5. Track/hold block 206 is included within the lower analog block 96 shown in FIG. 4, which operates at the lower power supply range VDD1/VSS1. Accordingly, the Hold signal generated by comparator 94 is first level-shifted by level shift block 196 to provide a level-shifted Hold signal on conductor 208. Track/hold circuit 206 is shown in greater detail in FIG. 9. P-channel transistor 210 passes the multiplexed analog voltage on conductor 202 onto storage capacitor 212 until the Hold signal on conductor 208 goes high, indicating a match. The high level on conductor 208 disables P-channel transistor 210, so the last analog voltage saved on capacitor 212 is the analog voltage corresponding to the digital word stored in data store block 92. Thus, the Hold signal causes the track/hold circuit 206 to capture the desired analog output voltage. This method assures that the output of the track/hold circuit 206 will have the correct voltage at the end of the voltage acquisition phase which lasts for 64 cycles of the Clock. Buffer amplifier 214 buffers and regenerates the analog voltage stored on capacitor 212, and reproduces such voltage on conductor 216 from a low impedance source.

Figure 9:
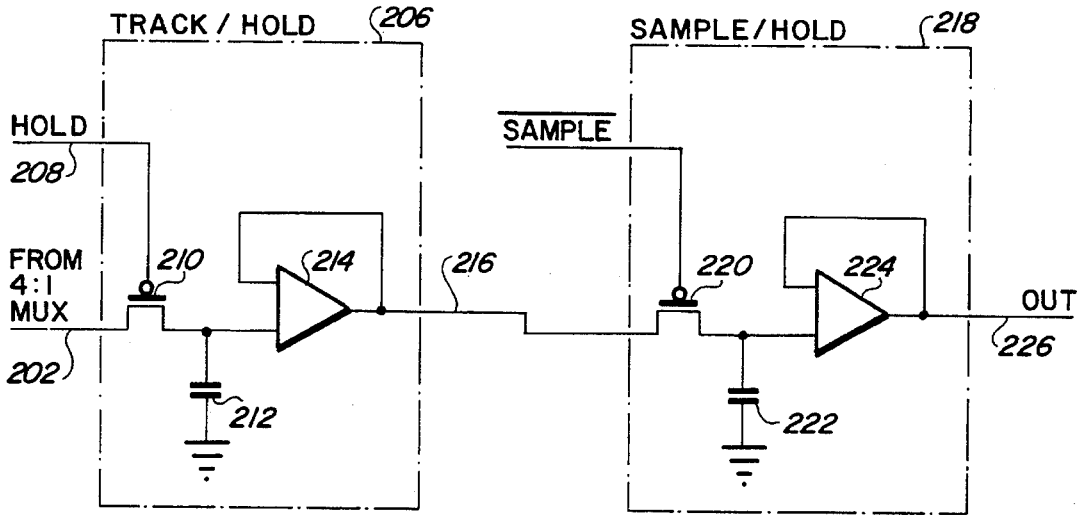
FIG. 9 is a circuit diagram showing the track/hold and sample/hold circuits of FIG. 5.

As described above, the column driver integrated circuit is pipelined in such a manner that, while the analog output voltages to be required for row 20 are generated during the second row update cycle, the analog voltages already generated for row 19 are simultaneously being output to the columns of the LCD display during the second row update cycle. As indicated in FIGS. 5 and 9, a sample/hold circuit block 218 is provided in each column output section for storing the analog output voltage that was selected during the immediately preceding row update cycle. Conductor 216, which provides the buffered analog output of track/hold block 206 is coupled to the input of sample/hold circuit block 218. When enabled by the negative transition of clocking signal $\overline{\text{SAMPLE}}$, P-channel transistor 220 passes the analog voltage on conductor 216 onto storage capacitor 222.

Clocking signal $\overline{\text{SAMPLE}}$ is a negative-going pulse generated near the end of each row update cycle, just before the occurrence of the above-described LOAD pulse. By the time that the negative-going pulse of $\overline{\text{SAMPLE}}$ occurs, all of the track/hold blocks have received a positive transition of their corresponding HOLD signals, so each of the track/hold blocks has latched onto the correct analog voltage that is to be output to the LCD display for row 20 during the third row update cycle. Accordingly, as the $\overline{\text{SAMPLE}}$ signal pulses low, the analog voltage that is to be driven onto the second column of the LCD display for row 20 is stored upon storage capacitor 222. The $\overline{\text{SAMPLE}}$ signal transitions back to a high level just as the next row update cycle begins, thereby disabling transistor 220, and capturing the desired analog output voltage that is to be output during the third row update cycle for row 20. Buffer amplifier 224 buffers and regenerates the analog voltage stored on capacitor 222, and reproduces such voltage on conductor 226 from a low impedance source. Conductor 226 is essentially the output from lower analog sampling block 96 of FIG. 4.

Upper analog sampling blocks 86 and 98 (see FIG. 4) function essentially in the same manner as has been described for lower analog sampling blocks 84 and 96, except that upper analog sampling blocks 86 and 98 are responsive to the analog voltages generated by Upper DAC block 68. As noted above, the analog voltages generated by Upper DAC block 68 are in a different range of voltages than for Lower DAC block 64. Both Lower DAC block 64 and Upper DAC block 68 produce 256 possible analog output voltages within their operating ranges. Accordingly, a total of 512 voltages are produced across the entire voltage range.

For each column output section, the lower analog sampling block and upper analog sampling block provide two different analog output voltages. As indicated in FIG. 4, the analog output voltages provided by the lower analog sampling block 96 and upper analog sampling block 98 are provided to an output multiplexer 100 which selects one of the two analog output voltages to the OUT2 output terminal of the column driver integrated circuit for coupling to the LCD display. A preferred embodiment of such an output multiplexer circuit is shown in the above-referenced co-pending patent application.

As indicated in FIG. 4, all of the output multiplexers may, if desired, be controlled by a single global polarity control block 76, which, in response to a control signal provided on conductor 228 by digital control block 72, provides common control signals on conductors 230 to all of the output multiplexers to simultaneously select either the lower analog output voltage or the upper analog output voltage to the output terminal. One application for such a global selection process may occur when it is desired to increase all gray shade voltages by the same amount of voltage to uniformly alter the appearance of the LCD display. In such instance, the polarity control circuit can switch from the lower analog voltage of each column output section to the upper analog voltage of each column output section and uniformly increase the voltage magnitude of all such gray shade voltages.

As described above, the Lower and Upper DAC blocks are capable of supplying 512 unique analog voltages; these 512 unique analog voltages can be specified by a nine-bit digital data word. In an alternate embodiment, the digital data words supplied on Data Bus 174 (see FIG. 4) are nine bits long, as opposed to the eight-bit width previously described. The extra ninth bit, or most-significant-bit, is used to select as between the lower analog output signal or the upper analog output signal in order to provide an analog output voltage at each column driver output that can assume one of 512 distinct analog voltages over the entire voltage range. A method of using such a most-significant-bit to control such selection is described in the above-referenced co-pending patent application. Those skilled in the art will appreciate that each column driver output section would need to include a latch coupled to the data store block for saving this ninth bit when the LOAD signal occurs, since this ninth bit would otherwise be lost when new data for the next row update cycle is transferred into the data store block.

Those skilled in the art will now appreciate that a circuit has been described which efficiently and inexpensively generates a plurality of analog voltages corresponding to a plurality of digital values, thereby performing a digital-to-analog conversion function for such digital values, all on a single integrated circuit. This circuit advantageously provides an integrated circuit column driver chip that is capable of generating a series of analog gray-shade output voltages, corresponding to varying shades of gray on an LCD display, locally on-board the integrated circuit column driver chip. The number of required externally-generated analog voltages is minimized, and no high-speed, rapid-switching digital-to-analog converters are needed. All 192 column driver output sections are provided with their corresponding analog voltages in a mere 64 shift register clock cycles. Likewise, as many as 512 distinct analog voltages are generated in a mere 64 shift register clock cycles, and if desired, such analog voltages can be generated in a non-linear fashion to suit particular voltage characteristics of the LCD display.

While the present invention has been described with respect to a preferred embodiment thereof, such description is for illustrative purposes only, and is not to be construed as limiting the scope of the invention. Various modifications and changes may be made to the described embodiment by those skilled in the art without departing from the true spirit and scope of the invention as defined by the appended claims.

We claim:

1. A monolithic digital-to-analog converter integrated circuit for converting a digital input signal to an analog output signal, the digital input signal including a plurality N of digital input bits, one of said digital input bits corresponding to a least significant bit, said circuit comprising in combination:

a. counting means having an input terminal for receiving a clocking signal, the clocking signal undergoing periodic transitions, said counting means having a plurality of output terminals for providing a counter output, said counting means being responsive to the clocking signal for sequencing the counter output through a series of unique output patterns;

b. an analog voltage generator having an input terminal for receiving the clocking signal, said analog voltage generator including a plurality of analog output terminals providing a corresponding plurality of different analog output voltages, said analog voltage generator being responsive to the clocking signal for changing the plurality of analog output voltages in a monotonic fashion in response to periodic transitions of the clocking signal;

c. comparison means having a first set of input terminals for receiving a first subset of the plurality N of digital input bits, the first subset excluding at least the least significant bit of the digital input signal, the first subset including M bits where M is smaller than N, said comparison means being coupled to said counting means and being responsive to the counter output, said comparison means generating a correlation signal indicating a correlation between the first subset of the digital input bits received at the first set of input terminals and the counter output; and d. selection means having an analog output port for providing an analog output signal corresponding to the digital input signal, said selection means being coupled to the analog output terminals of said analog voltage generator for receiving the plurality of analog output voltages, said selection means also being coupled to said comparison means for receiving said correlation signal, said selection means receiving a second subset of the plurality N of digital input bits, the second subset excluding the first subset of such digital input bits of the digital input signal, said selection means being responsive to said correlation signal for selecting one of the plurality of analog output voltages to said analog output port as the analog output signal in accordance with the second subset of the digital input bits.

2. A circuit recited by claim 1 wherein said analog voltage generator includes:

a. shift means having a plurality M of control terminals, said shift means being responsive to the clocking signal to individually enable, in succession, the M control terminals thereof;

b. a resistive divider network extending between first and second reference voltages, said resistive divider network having a series of at least 2 times M tap points extending therealong for providing at least 2 times M analog voltages that monotonically increase between the first reference voltage and the second reference voltage; and c. switching means coupled to the series of at least 2 times M tap points of said resistive divider network, said switching means being coupled with the control terminals of said shift means and being responsive to the enabled one of said control terminals to selectively couple first and second successive analog voltages provided at a corresponding pair of said tap points to first and second analog output terminals of said analog output voltage generator, respectively.

3. The circuit recited by claim 2 wherein said shift means includes an M-stage shift register having M stages, each of said M stages providing one of said plurality M of output terminals, said M-stage shift register having a clock input terminal for receiving the clocking signal, said M-stage shift register causing a data bit to be serially shifted through each of the M stages of said M-stage shift register in response to consecutive transitions of the clocking signal to enable, in succession, the output terminals of each of said M stages of said M-stage shift register.

4. The circuit recited by claim 2 wherein said counting means includes a binary counter responsive to the clocking signal for providing a binary-weighted counter output of fewer than N bits, and wherein said comparison means includes a second set of input terminals for receiving the binary-weighted counter output, and wherein said comparison means compares the first subset of digital input bits of the digital input signal received at the first set of input terminals to the binary-weighted counter output received at the second set of input terminals for generating the correlation signal when the binary-weighted counter output matches the first subset of digital input bits of the digital input signal.

5. The circuit recited by claim 4 including synchronizing means for synchronizing an initial count in said binary counter with the beginning of the serial shifting of the data bit through the M stages of said M-stage shift register.

6. The circuit recited by claim 2 wherein the series of at least 2 times M analog voltages provided along the series of at least 2 times M tap points of the resistive divider network monotonically increase between the first reference voltage and the second reference voltage in a non-linear manner.

7. A monolithic digital-to-analog converter integrated circuit for converting a digital input signal to an analog output signal, the digital input signal including a plurality N of digital input bits, one of said digital input bits corresponding to a least significant bit, said circuit comprising in combination:

a. counting means having an input terminal for receiving a clocking signal and having a plurality of output terminals for providing a counter output, said counting means being responsive to the clocking signal for sequencing the counter output through a series of unique output patterns;

b. an analog voltage generator coupled to said counting means and responsive to the counter output, said analog voltage generator including a plurality of analog output terminals providing a corresponding plurality of different analog output voltages for each different counter output pattern, the plurality of analog output voltages changing in a monotonic fashion as the counter output is sequenced;

c. comparison means having a first set of input terminals for receiving a first subset of the plurality N of digital input bits, the first subset excluding at least the least significant bit of the digital input signal, the first subset including M bits where M is smaller than N, said comparison means being coupled to said counting means and being responsive to the counter output, said comparison means generating a correlation signal indicating a correlation between the first subset of the digital input bits received at the first set of input terminals and the counter output; and d. selection means having an analog output port for providing an analog output signal corresponding to the digital input signal, said selection means being coupled to the analog output terminals of said analog voltage generator for receiving the plurality of analog output voltages, said selection means also being coupled to said comparison means for receiving said correlation signal, said selection means receiving a second subset of the plurality N of digital input bits, the second subset excluding the first subset of such digital input bits of the digital input signal, said selection means being responsive to said correlation signal for selecting one of the plurality of analog output voltages to said analog output port as the analog output signal in accordance with the second subset of the digital input bits.

8. A circuit as recited by claim 7 wherein said counting means includes a binary counter responsive to the clocking signal for providing a binary-weighted counter output of fewer than N bits, and wherein said comparison means includes a second set of input terminals for receiving the binary-weighted counter output, and wherein said comparison means compares the first subset of digital input bits of the digital input signal received at the first set of input terminals to the binary-weighted counter output received at the second set of input terminals for generating the correlation signal when the binary-weighted counter output matches the first subset of digital input bits of the digital input signal.

9. A circuit recited by claim 7 wherein:

a. said counting means includes a plurality M of control terminals, said counting means being responsive to the clocking signal to individually enable, in succession, the M control terminals thereof;

b. said analog voltage generator includes:

i. a resistive divider network extending between first and second reference voltages, said resistive divider network having a series of at least 2 times M tap points extending therealong for providing at least 2 times M analog voltages that monotonically increase between the first reference voltage and the second reference voltage; and ii. switching means coupled to the series of at least 2 times M tap points of said resistive divider network, said switching means being coupled with the control terminals of said counting means and being responsive to the enabled one of said control terminals to selectively couple first and second successive analog voltages provided at a corresponding pair of said tap points to first and second analog output terminals of said analog output voltage generator, respectively.

10. The circuit recited by claim 9 wherein said counting means includes an M-stage shift register having M stages, each of said M stages providing one of said plurality M of output terminals, said M-stage shift register having a clock input terminal for receiving the clocking signal, said M-stage shift register causing a data bit to be serially shifted through each of the M stages of said M-stage shift register in response to consecutive pulses of the clocking signal to enable, in succession, the output terminals of each of said M stages of said M-stage shift register.

11. The circuit recited by claim 9 wherein said switching means includes a plurality of at least 2 times M CMOS transistors coupled between said resistive divider network and said analog output terminals, each of said CMOS transistors having a gate terminal, and wherein each control terminal of said counting means is coupled to the gate terminals of at least two of said CMOS transistors for rendering conductive such at least two CMOS transistors when each such control terminal is enabled.

12. The circuit recited by claim 9 wherein the series of at least 2 times M analog voltages provided along the series of at least 2 times M tap points of the resistive divider network monotonically increase between the first reference voltage and the second reference voltage in a non-linear manner.

13. A monolithic digital-to-analog converter integrated circuit for converting a digital input signal to an analog output signal, said circuit comprising in combination:

a. receiving means for receiving a digital input signal;

b. counting means having an input terminal for receiving a clocking signal and having a plurality of output terminals for providing a counter output, said counting means being responsive to the clocking signal for sequencing the counter output through a series of unique output patterns;

c. an analog voltage generator coupled to said counting means and responsive to the counter output for generating a unique analog voltage for each different counter output, said analog voltage generator including at least one analog output terminal for providing the unique analog voltage;

d. comparison means coupled to said receiving means and responsive to the digital input signal, said comparison means being coupled to said counting means and responsive to the counter output for generating a correlation signal indicating a correlation between the digital input signal and the counter output; and e. selection means having an output port for providing an analog output signal corresponding to the digital input signal, said selection means being coupled to the analog output terminal of said analog voltage generator for receiving the unique analog voltage, said selection means being coupled to the comparison means and responsive to the correlation signal for selecting the unique analog voltage to the output port as the analog output signal upon the generation of the correlation signal.

14. The circuit recited by claim 13 including sample and hold means coupled to the output port of said selection means for sampling and holding the analog output signal following generation of the correlation signal.

15. The circuit recited by claim 13 wherein:

a. said analog voltage generator is responsive to the counter output for generating at least first and second unique analog voltages for each different counter output, said analog voltage generator including at least two analog output terminals for providing the first and second unique analog voltages;

b. said selection means being coupled to said at least two analog output terminals of said analog voltage generator for receiving the first and second unique analog voltages, said selection means being coupled to said receiving means and responsive to the least significant bit of the first digital input signal for selecting either the first or second unique analog voltage to the first output port as the first analog output signal upon the generation of the first correlation signal.

16. The circuit recited by claim 13 wherein:

a. said counting means includes a plurality N of control terminals, said counting means being responsive to the clocking signal to individually enable, in succession, the control terminals thereof;

b. said analog voltage generator includes:

i. a resistive divider network extending between first and second reference voltages, said resistive divider network having a series of at least N tap points extending therealong for providing at least N analog voltages that monotonically increase between the first reference voltage and the second reference voltage; and ii. switching means including a first analog output terminal, said switching means being coupled to the series of at least N tap points of said resistive divider network, said switching means being coupled with the control terminals of said counting means and being responsive to the enabled one of said control terminals to selectively couple the analog voltage provided at a corresponding one of said tap points to the first analog output terminal.

17. The circuit recited by claim 16 wherein said resistive divider network has at least 2 times N tap points extending therealong for providing at least 2 times N analog voltages that monotonically increase between the first reference voltage and the second reference voltage, and wherein said switching means includes a second analog output terminal, said switching means being coupled to the at least 2 times N tap points of said resistive divider network to selectively couple first and second successive analog voltages provided at a corresponding pair of said tap points to the first and second analog output terminals, respectively.

18. A monolithic digital-to-analog converter integrated circuit for converting digital input signals to analog output signals, said circuit comprising in combination:

a. first storage means for storing a first digital input signal;

b. counting means having an input terminal for receiving a clocking signal and having a plurality of output terminals for providing a counter output, said counting means being responsive to the clocking signal for sequencing the counter output through a series of unique output patterns;

c. an analog voltage generator coupled to said counting means and responsive to the counter output for generating at least one unique analog voltage for each different counter output, said analog voltage generator including at least one analog output terminal for providing the at least one analog voltage;

d. first comparison means coupled to said first storage means and responsive to the first digital input signal, said first comparison means being coupled to said counting means and responsive to the counter output for generating a first correlation signal indicating a correlation between the first digital input signal and the counter output; and e. first selection means having a first output port for providing a first analog output signal corresponding to the first digital input signal, said first selection means being coupled to said analog voltage generator for receiving the at least one analog voltage, said first selection means being coupled to the first comparison means and responsive to the first correlation signal for selecting the at least one analog voltage to the first output port as the first analog output signal upon the generation of the first correlation signal.

19. A circuit as recited by claim 18 including first sample and hold means coupled to the first output port of said first selection means for sampling and holding the first analog output signal following generation of the first correlation signal.

20. A circuit as recited by claim 18 further including:

a. second storage means for storing a second digital input signal;

b. second comparison means coupled to said second storage means and responsive to the second digital input signal, said second comparison means being coupled to said counting means and responsive to the counter output for generating a second correlation signal indicating a correlation between the second digital input signal and the counter output; and c. second selection means having a second output port for providing a second analog output signal corresponding to the second digital input signal, said second selection means being coupled to said analog voltage generator for receiving the at least one analog voltage, said second selection means being coupled to the second comparison means and responsive to the second correlation signal for selecting the at least one analog voltage to the second output port as the second analog output signal upon the generation of the second correlation signal.

21. A circuit as recited by claim 20 including:

a. first sample and hold means coupled to the first output port of said first selection means for sampling and holding the first analog output signal following generation of the first correlation signal; and b. second sample and hold means coupled to the second output port of said second selection means for sampling and holding the second analog output signal following generation of the second correlation signal.

22. A circuit as recited by claim 18 wherein:

a. said analog voltage generator is responsive to the counter output for generating at least first and second unique analog voltages for each different counter output, said analog voltage generator including at least two analog output terminals for providing the first and second analog voltages;

b. said first selection means being coupled to said at least two analog output terminals of said analog voltage generator for receiving the first and second analog voltages, said first selection means being coupled to the first storage means and responsive to the least significant bit of the first digital input signal for selecting either the first or second analog voltage to the first output port as the first analog output signal upon the generation of the first correlation signal.

23. A circuit as recited by claim 22 including first sample and hold means coupled to the first output port of said first selection means for sampling and holding the first analog output signal following generation of the first correlation signal.

24. A circuit as recited by claim 22 further including:

a. second storage means for storing a second digital input signal;

b. second comparison means coupled to said second storage means and responsive to the second digital input signal, said second comparison means being coupled to said counting means and responsive to the counter output for generating a second correlation signal indicating a correlation between the second digital input signal and the counter output; and c. second selection means having a second output port for providing a second analog output signal corresponding to the second digital input signal, said second selection means being coupled to said at least two analog output terminals of said analog voltage generator for receiving the first and second analog voltages, said second selection means being coupled to the second comparison means and responsive to the second correlation signal, said second selection means being coupled to the second storage means and responsive to the least significant bit of the second digital input signal for selecting either the first or second analog voltage to the second output port as the second analog output signal upon the generation of the second correlation signal.

25. A circuit as recited by claim 24 including:

a. first sample and hold means coupled to the first output port of said first selection means for sampling and holding the first analog output signal following generation of the first correlation signal; and b. second sample and hold means coupled to the second output port of said second selection means for sampling and holding the second analog output signal following generation of the second correlation signal.

26. A circuit as recited by claim 18 wherein:

a. said counting means includes a plurality N of control terminals, said counting means being responsive to the clocking signal to individually enable, in succession, the control terminals thereof;

b. said analog voltage generator includes:

i. a resistive divider network extending between first and second reference voltages, said resistive divider network having a series of at least N tap points extending therealong for providing at least N analog voltages that monotonically increase between the first reference voltage and the second reference voltage; and ii. switching means including a first analog output terminal, said switching means being coupled to the series of at least N tap points of said resistive divider network, said switching means being coupled with the control terminals of said counting means and being responsive to the enabled one of said control terminals to selectively couple the analog voltage provided at a corresponding one of said tap points to the first analog output terminal.

27. The circuit recited by claim 26 wherein said resistive divider network has at least 2 times N tap points extending therealong for providing at least 2 times N analog voltages that monotonically increase between the first reference voltage and the second reference voltage, and wherein said switching means includes a second analog output terminal, said switching means being coupled to the at least 2 times N tap points of said resistive divider network to selectively couple first and second successive analog voltages provided at a corresponding pair of said tap points to the first and second analog output terminals, respectively.

28. A circuit for generating a consecutive series of monotonically increasing analog voltages, said circuit comprising in combination:

a. clocking means for providing a pulsed clock signal;

b. counting means coupled to said clocking means for counting pulses of the pulsed clock signal, said counting means including a plurality N of output terminals, said counting means being responsive to consecutive pulses of the pulsed clock signal to individually enable, in succession, the output terminals thereof;

c. a resistive divider network extending between first and second reference voltages, said resistive divider network having a series of at least N tap points extending therealong for providing at least N analog voltages that monotonically increase between the first reference voltage and the second reference voltage; and d. switching means including a first analog output terminal, said switching means being coupled to the series of at least N tap points of said resistive divider network, said switching means being coupled with the output terminals of said counting means and being responsive to the enabled output terminal thereof to selectively couple the analog voltage provided at a corresponding one of said tap points to the first analog output terminal.

29. The circuit recited by claim 28 wherein said resistive divider network has at least 2 times N tap points extending therealong for providing at least 2 times N analog voltages that monotonically increase between the first reference voltage and the second reference voltage, and wherein said switching means includes a second analog output terminal, said switching means being coupled to the at least 2 times N tap points of said resistive divider network to selectively couple first and second successive analog voltages provided at a corresponding pair of said tap points to the first and second analog output terminals, respectively.

30. The circuit recited by claim 28 wherein said counting means includes an N-stage shift register having N stages, each of said N stages providing one of said plurality N of output terminals, said N-stage shift register having a clock input terminal coupled to said clocking means for receiving the pulsed clock signal, said N-stage shift register causing a data bit to be serially shifted through each of the N stages of said N-stage shift register in response to consecutive pulses of the pulsed clock signal to enable, in succession, the output terminals of each of said N stages of said N-stage shift register.

31. The circuit recited by claim 28 wherein said switching means includes a plurality of at least N CMOS transistors coupled between said resistive divider network and said first analog output terminal, each of said CMOS transistors having a gate terminal, and wherein the gate terminal of each of said CMOS transistors is coupled to one of the output terminals of said counting means for being rendered conductive when each such output terminal is enabled.

32. The circuit recited by claim 31 wherein the CMOS transistors of said switching means, said resistive divider network, and said counting means are all formed upon a single, monolithic integrated circuit.

33. The circuit recited by claim 29 wherein said switching means includes a plurality of at least 2 times N CMOS transistors coupled between said resistive divider network and said first analog output terminal, each of said CMOS transistors having a gate terminal, and wherein each output terminal of said counting means is coupled to the gate terminals of at least two of said CMOS transistors for rendering conductive such at least two CMOS transistors when each such output terminal is enabled.

34. The circuit recited by claim 33 wherein the CMOS transistors of said switching means, said resistive divider network, and said counting means are all formed upon a single, monolithic integrated circuit.

35. The circuit recited by claim 28 wherein the voltage drop between a first and a second successive tap point differs from the voltage drop between a third and a fourth successive tap point.

36. The circuit recited by claim 28 wherein the series of at least N analog voltages provided along the series of at least N tap points of the resistive divider network monotonically increase between the first reference voltage and the second reference voltage in a non-linear manner.

* * * * *